US010894653B2

(12) United States Patent
Lambert et al.

(10) Patent No.: US 10,894,653 B2
(45) Date of Patent: Jan. 19, 2021

(54) EXTRACTOR HOOD PACKING SYSTEM

(71) Applicants: BSH Home Appliances Corporation, Irvine, CA (US); BSH Hausgeräte GmbH, Munich (DE)

(72) Inventors: Richard Lambert, Knoxville, TN (US); Michael Reule, Brühl (DE); Michael Rutherford, Duff, TN (US); Derek Turner, Caryville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 126 days.

(21) Appl. No.: 16/214,413

(22) Filed: Dec. 10, 2018

(65) Prior Publication Data

US 2020/0180839 A1 Jun. 11, 2020

(51) Int. Cl.
*B65D 81/113* (2006.01)
*B65D 81/05* (2006.01)
*B65D 85/64* (2006.01)

(52) U.S. Cl.
CPC ..... *B65D 81/113* (2013.01); *B65D 81/057* (2013.01); *B65D 85/64* (2013.01); *B65D 2581/051* (2013.01); *B65D 2585/6815* (2013.01)

(58) Field of Classification Search
CPC ..... B65D 81/058; B65D 2585/6815; B65D 81/113; B65D 81/057; B65D 85/64; B65D 2581/051
USPC ..... 206/320, 523, 521, 590, 589, 586
See application file for complete search history.

(56) References Cited

U.S. PATENT DOCUMENTS 3,471,116 A * 10/1969 Cherrie ..... B65D 19/00 410/46
5,385,232 A * 1/1995 Foos ..... B65D 81/025 206/320
6,105,765 A * 8/2000 Chu ..... B65D 81/025 206/320
6,554,133 B1 * 4/2003 Kropf ..... B65D 81/113 206/320

(Continued)

FOREIGN PATENT DOCUMENTS

CN 204507789 U 7/2015
CN 204937903 U 1/2016

(Continued)

*Primary Examiner* — Steven A. Reynolds
(74) *Attorney, Agent, or Firm* — Michael E. Tschupp; Andre Pallapies; Brandon G. Braun

(57) ABSTRACT

A packing holder for an extractor hood includes a first receiving portion having a first groove configured to receive edges of first and second parts of a chimney cover, the first groove having a bottom surface that is a first distance from an outer surface of an outer side in a thickness direction; a second receiving portion having a second groove configured to receive edges of third and fourth parts of the chimney cover, the second groove having a bottom surface that is a second distance from the outer surface of the outer side in the thickness direction; and a central receiving portion located between the first receiving portion and the second receiving portion along a longitudinal direction that is perpendicular to the thickness direction, and configured to receive a chimney frame, wherein the second distance is smaller than the first distance.

14 Claims, 12 Drawing Sheets

(56) References Cited

U.S. PATENT DOCUMENTS

| | | | | |
|---|---|---|---|---|
| 2005/0092633 | A1* | 5/2005 | Baechle | B65D 61/00 206/320 |
| 2008/0127196 | A1* | 5/2008 | Barsness | G06Q 30/0611 718/104 |
| 2008/0160249 | A1* | 7/2008 | Makino | B65D 71/72 428/116 |
| 2011/0266177 | A1* | 11/2011 | Lowry | B65D 85/68 206/230 |
| 2013/0100359 | A1* | 4/2013 | Yokawa | B65D 81/113 348/836 |

FOREIGN PATENT DOCUMENTS

| | | | |
|---|---|---|---|
| CN | 105460426 | A | 4/2016 |
| CN | 105716125 | A | 6/2016 |
| DE | 20316126 | U1 | 12/2003 |
| EP | 2128040 | A1 | 12/2009 |

* cited by examiner

EXTRACTOR HOOD PACKING SYSTEM

FIELD

The present invention relates generally to appliances. More specifically, particular embodiments of the invention relate to a system for packing an extractor hood for a cooktop.

BACKGROUND

Many domestic kitchens include a cooktop in a location that can be benefited by an extractor hood positioned above the cooktop. For example, a cooktop located in the countertop of an island can have an extractor hood that is attached to the ceiling above the island and extends down toward the cooktop. The extractor hood can include a fan that creates an airflow that extracts heat, smoke, steam, and other gases and particles generated by the cooktop away from the cooktop and out of the kitchen.

Many of these extractor hoods include highly polished or otherwise decorative pieces that can be part of a central visual presence in very expensive and attractive kitchens. Effectively protecting these pieces during transportation to the installation site has proven to be a challenging problem.

Accordingly, an improved system is desired for packing, storing, and shipping extractor hoods.

SUMMARY

An improved system for packing, storing, and shipping extractor hoods helps protect expensive and decorative finishes and helps protect against denting or other damage. Embodiments of the invention provide this improved system in a cost effective and efficient manner.

In one aspect, a packing holder for portions of an extractor hood, the extractor hood including a main body, a multi-piece chimney cover, and a chimney frame, includes an outer side having an outer surface; an inner side opposite to the outer side in a thickness direction; a first receiving portion in the inner side, the first receiving portion having a first groove configured to receive an edge of a first part of the chimney cover and an edge of a second part of the chimney cover, the first groove having a bottom surface that is configured to contact the edge of the first part of the chimney cover and the edge of the second part of the chimney cover when the first part of the chimney cover and the second part of the chimney cover are installed in the packing holder, the bottom surface being a first distance from the outer surface of the outer side in the thickness direction; a second receiving portion in the inner side, the second receiving portion having a second groove configured to receive an edge of a third part of the chimney cover and an edge of a fourth part of the chimney cover, the second groove having a bottom surface that is configured to contact the edge of the third part of the chimney cover and the edge of the fourth part of the chimney cover when the third part of the chimney cover and the fourth part of the chimney cover are installed in the packing holder, the bottom surface being a second distance from the outer surface of the outer side in the thickness direction; and a central receiving portion located between the first receiving portion and the second receiving portion along a longitudinal direction that is perpendicular to the thickness direction, and configured to receive the chimney frame. The second distance is smaller than the first distance.

In some embodiments, a plurality of first ribs are located in the first receiving portion, wherein the first groove comprises a plurality of first grooves, each of the first grooves being located in one of the first ribs.

In one aspect a packing system for portions of an extractor hood, the extractor hood including a main body, a multi-piece chimney cover, and a chimney frame, includes two packing holders. Each of the packing holders has an outer side having an outer surface; an inner side opposite to the outer side in a thickness direction; a first receiving portion in the inner side, the first receiving portion having a first groove configured to receive an edge of a first part of the chimney cover and an edge of a second part of the chimney cover, the first groove having a bottom surface that is configured to contact the edge of the first part of the chimney cover and the edge of the second part of the chimney cover when the first part of the chimney cover and the second part of the chimney cover are installed in the packing holder, the bottom surface being a first distance from the outer surface of the outer side in the thickness direction; a second receiving portion in the inner side, the second receiving portion having a second groove configured to receive an edge of a third part of the chimney cover and an edge of a fourth part of the chimney cover, the second groove having a bottom surface that is configured to contact the edge of the third part of the chimney cover and the edge of the fourth part of the chimney cover when the third part of the chimney cover and the fourth part of the chimney cover are installed in the packing holder, the bottom surface being a second distance from the outer surface of the outer side in the thickness direction; and a central receiving portion located between the first receiving portion and the second receiving portion along a longitudinal direction that is perpendicular to the thickness direction, and configured to receive the chimney frame. The second distance is smaller than the first distance, and the two packing holders are configured to be arranged on opposite sides of the main body, the multi-piece chimney cover, and the chimney frame.

In some embodiments, each of the packing holders further includes a plurality of first ribs located in the first receiving portion, wherein the first groove comprises a plurality of first grooves, each of the first grooves being located in one of the first ribs.

In one aspect, a combination of a packing system and an extractor hood includes an extractor hood main body; a chimney cover having a first part, a second part, a third part, and a fourth part; a chimney frame; and two packing holders. Each of the packing holders has an outer side having an outer surface; an inner side opposite to the outer side in a thickness direction; a first receiving portion in the inner side, the first receiving portion having a first groove that receives an edge of the first part of the chimney cover and an edge of the second part of the chimney cover, the first groove having a bottom surface that contacts the edge of the first part of the chimney cover and the edge of the second part of the chimney cover when the first part of the chimney cover and the second part of the chimney cover are installed in the packing holder, the bottom surface being a first distance from the outer surface of the outer side in the thickness direction; a second receiving portion in the inner side, the second receiving portion having a second groove that receives an edge of the third part of the chimney cover and an edge of the fourth part of the chimney cover, the second groove having a bottom surface that contacts the edge of the third part of the chimney cover and the edge of the fourth part of the chimney cover when the third part of the chimney cover and the fourth part of the chimney cover are installed in the packing holder, the bottom surface being a second distance from the outer surface of the outer side in the thickness direction; and a central receiving portion located between the first receiving portion and the second receiving portion along a longitudinal direction that is perpendicular to the thickness direction, and receiving the chimney frame. The second distance is smaller than the first distance, and the two packing holders are arranged on opposite sides of the main body, the chimney cover, and the chimney frame.

In some embodiments, each of the packing holders further includes a plurality of first ribs located in the first receiving portion, wherein the first groove comprises a plurality of first grooves, each of the first grooves being located in one of the first ribs.

Further areas of applicability of the present invention will become apparent from the detailed description provided hereinafter. It should be understood that the detailed description and specific examples, while indicating preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
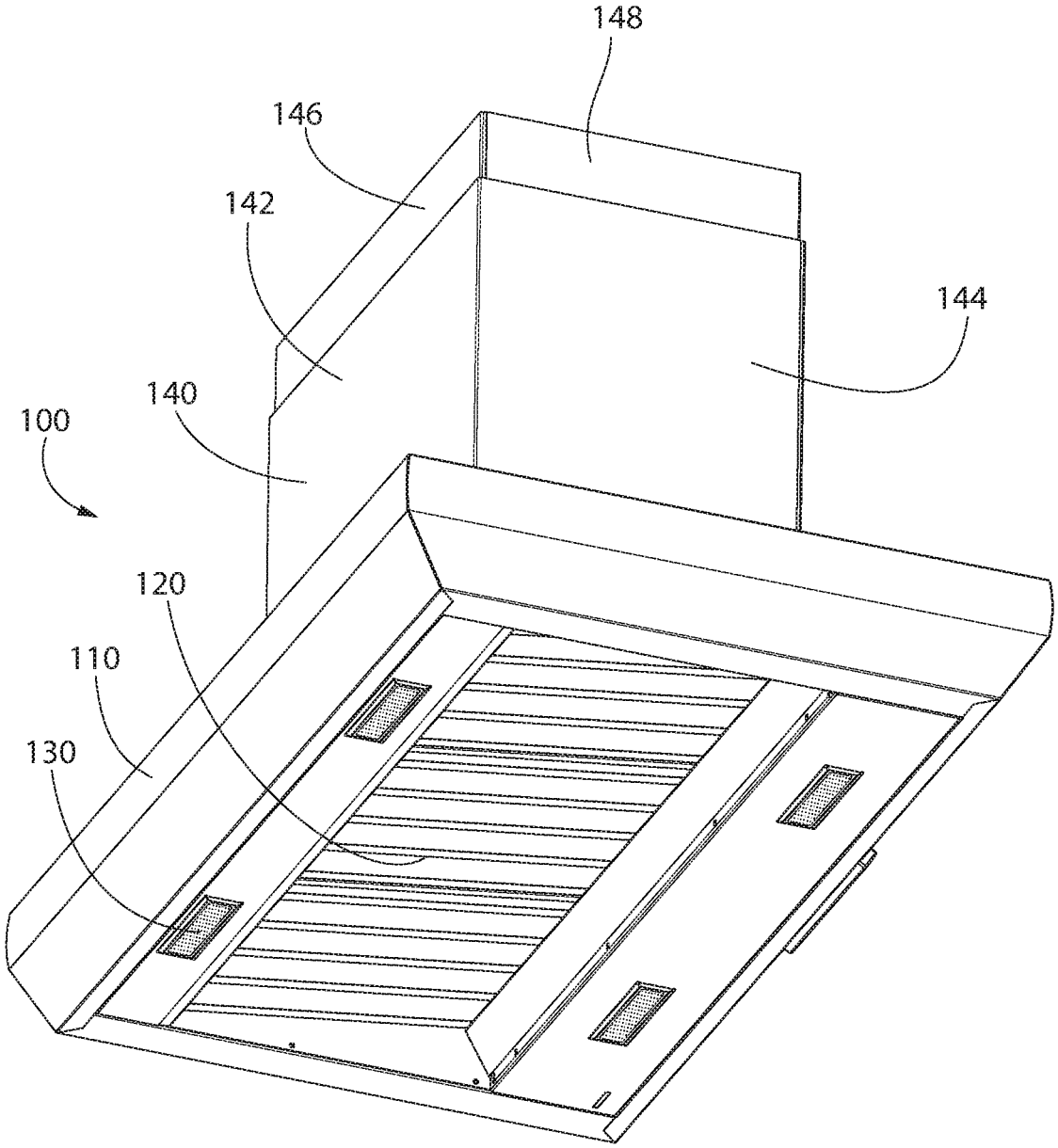
FIG. 1 is a perspective view of an extractor hood in accordance with exemplary embodiments of the invention.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The following description of the preferred embodiment(s) is merely exemplary in nature and is in no way intended to limit the invention, its application, or uses.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "connected," "coupled," "interconnected," and similar refer to a relationship wherein structures are secured or attached to one another either directly or indirectly through intervening structures, as well as both movable or rigid attachments or relationships, unless expressly described otherwise. The term "fixed" refers to two structures that cannot be separated without damaging one of the structures. The term "filled" refers to a state that includes completely filled or partially filled.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

As stated above, an improved system is desired for packing, storing, and shipping extractor hoods. Embodiments of the invention provide such an improved system.

FIG. 1 shows an example of an extractor hood 100 in accordance with embodiments of the invention. In this example, extractor hood 100 has a main body 110 that houses a plurality of elements. Extractor hood 100 has, in this example, four lights 130 that can project light onto a cooking surface and/or other surface located below extractor hood 100. Extractor hood 100 also has a filter, or plurality of filters, 120. Filter 120 covers an inlet (not shown) to a fan that produces an airflow upward and through extractor hood 100. An exhaust duct (not shown) can extend from filter 120 upward through a chimney cover 140 and into building structure above extractor hood 100 or some other route that channels extracted gases and/or particles away from extractor hood 100. In some installations, the extracted gases and/or particles are channeled to a vent that is located outside of the building in which extractor hood 100 is located. In this example, chimney cover 140 includes four pieces that are connected to each other to form a telescoping arrangement. First piece 142 of chimney cover 140 attaches to second piece 144 of chimney cover 140 by, for example, friction clips to form an outer section of chimney cover 140. In other embodiments, first piece 142 and second piece 144 are attached to each other by screws, rivets, or other fasteners. Third piece 146 of chimney cover 140 attaches to fourth piece 148 of chimney cover 140 by, for example, friction clips to form an inner section of chimney cover 140. In other embodiments, third piece 146 and fourth piece 148 are attached to each other by screws, rivets, or other fasteners. The outer section of chimney cover 140 can be positioned at different locations relative to the inner section of chimney cover 140 in order to provide adjustability in the length of chimney section 140. In some embodiments, the outer section of chimney cover 140 can slide relative to the inner section of chimney cover 140. In other embodiments, the outer section of chimney cover 140 is assembled at its final position relative to inner section of chimney cover 140 and the two sections do not move relative to each other. In some embodiments, the inner section of chimney cover 140 is fastened to the outer section of chimney cover 140 by screws, rivets, or other fasteners.

Extractor hood main body 110 and/or chimney cover 140 can be stainless steel, copper, other metal, or a non-metallic material.

Which FIG. 1 shows an example of an extractor hood in accordance with embodiments of the invention, other configurations of extractor hoods can also be provided.

Figure 2:
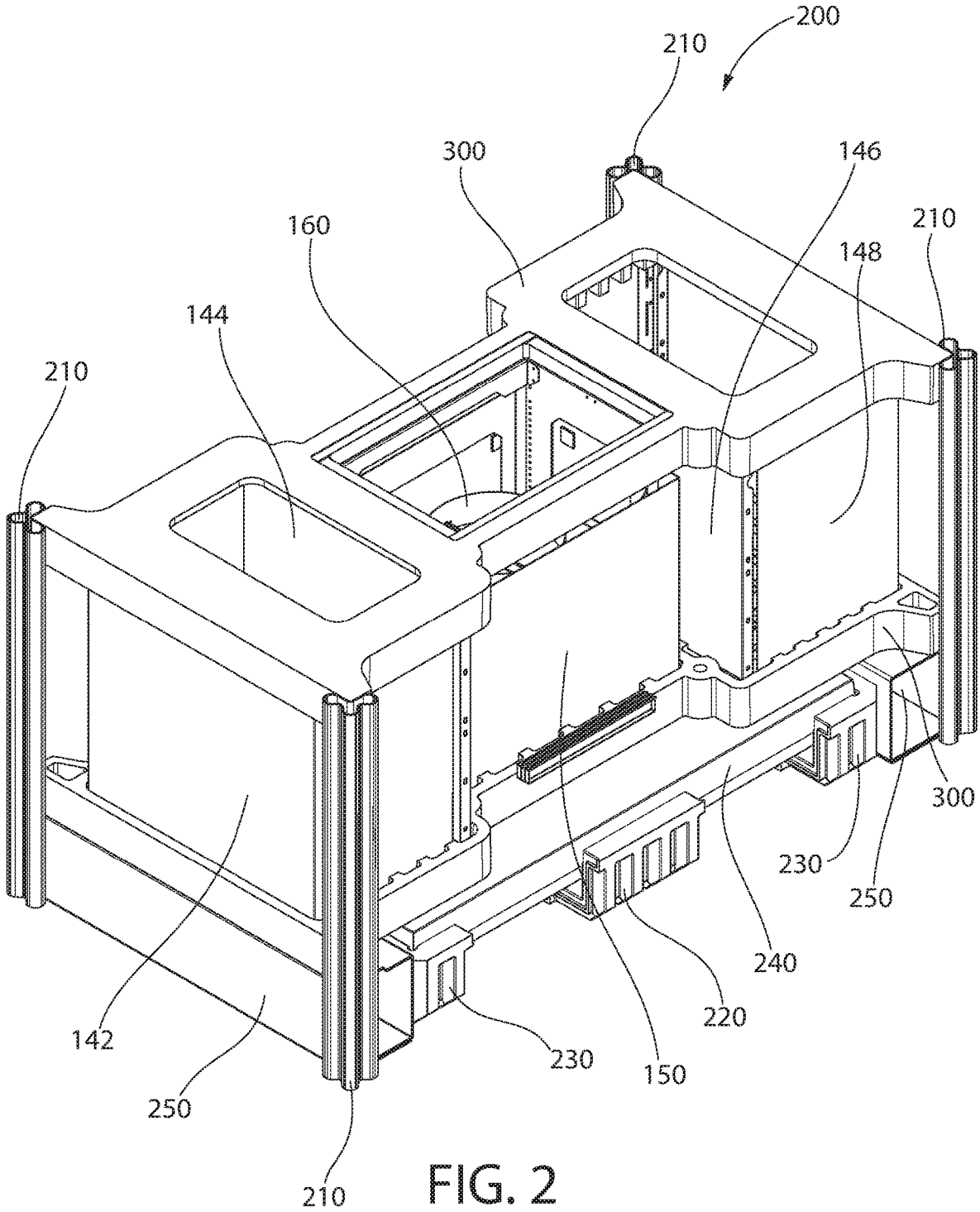
FIG. 2 is a perspective view of an extractor hood packing system in accordance with exemplary embodiments of the invention.

FIG. 2 shows an example of a packing system 200 that safely and efficiently packages exhaust hood 100 for transport, shipping and/or delivery. In this example, packing system 200 includes four corner members 210 that position the remaining pieces of packing system 200 in a box or other outer container (not shown). Corner members 210 can be cardboard, plastic, or some other material. Corner members 210 can cushion the remaining pieces of packing system 200 from impacts suffered by the box or other outer container. Such cushioning can be the result of deformation, either plastic or elastic, of corner pieces 210.

In this example, packing system 200 includes two packing holders 300 (explained in more detail below) spaced apart from one another and holding several pieces of extractor hood 100. Below the lower packing holder 300 is a space for main body 110 of extractor hood 100. In this example, main body 110 is located in a main body box 240 that can be a cardboard box, plastic box, some other material box, or a wrapping such as foam or bubble wrap. Main body box 240 is held in position by, in this example, two end main body box supports 230 and a central main body box support 220. In some embodiments, main body 110 of extractor hood 100, and thus main body box 240, are of a size that one or more spacers 250 are provided to hold end main body box supports 230 in position. In some embodiments, main body 110 of extractor hood 100, and thus main body box 240, is large enough that no spacers 250 are needed. By orienting main body box 240 horizontally and placing it below packing holders 300, the resulting package can tend to be bottom heavy and thus more stable when multiple packages are stacked for shipping and/or storage. The embodiment shown in FIG. 2 is just one example of how and where main body 110 is packaged by packing system 200.

In the embodiment shown in FIG. 2, packing holders 300 hold first piece 142 of chimney cover 140 and second piece 144 of chimney cover 140 at one end of packing holders 300; third piece 146 of chimney cover 140 and fourth piece 148 of chimney cover 140 at another end of packing holders 300; and a chimney frame 150 and a transition piece 160 at a central area of packing holders 300. In embodiments, chimney frame 150 is a structural member, or members, that attaches main body 110 of extractor hood 100 (or some other part of extractor hood 100) to the building structure above extractor hood 100. In embodiments, chimney frame 150 is hidden in the final installation by chimney cover 140. In embodiments, transition piece 160 is a piece of duct that transitions from one cross-sectional shape, such as a rectangle, to another cross-sectional shape, such as a circle, to transition the exhaust duct from one cross-section to another. Transition piece 160 is located, in this example, above main body 110 and inside chimney frame 150 in the final installation.

Figure 3:
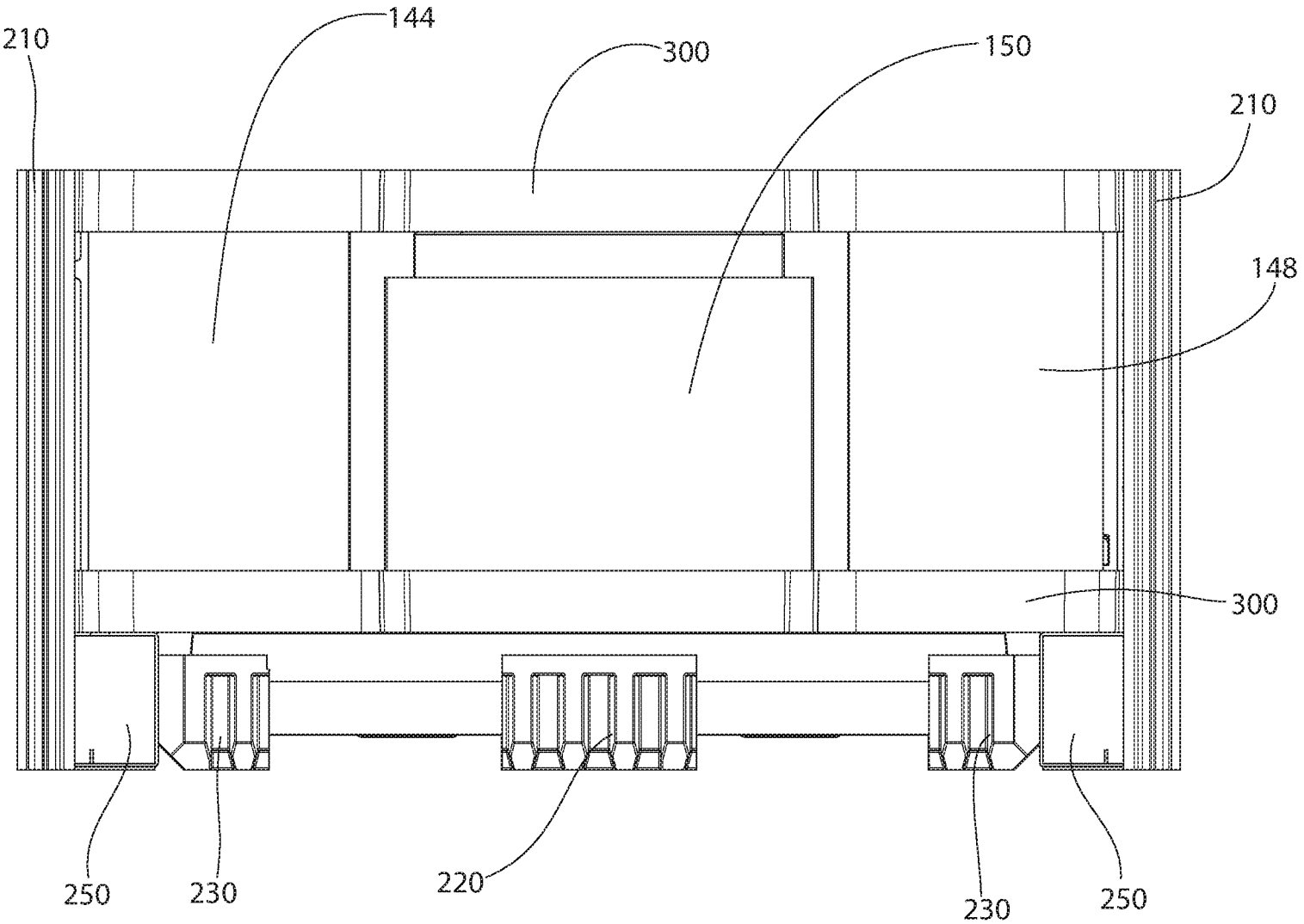
FIG. 3 is a front view of the system shown in FIG. 2.

FIG. 3 is a side view of packing system 200 and shows the relative positions of second piece of chimney cover 144, chimney frame 150, and fourth piece of chimney cover 148 between the upper packing holder 300 and the lower packing holder 300.

Figure 4:
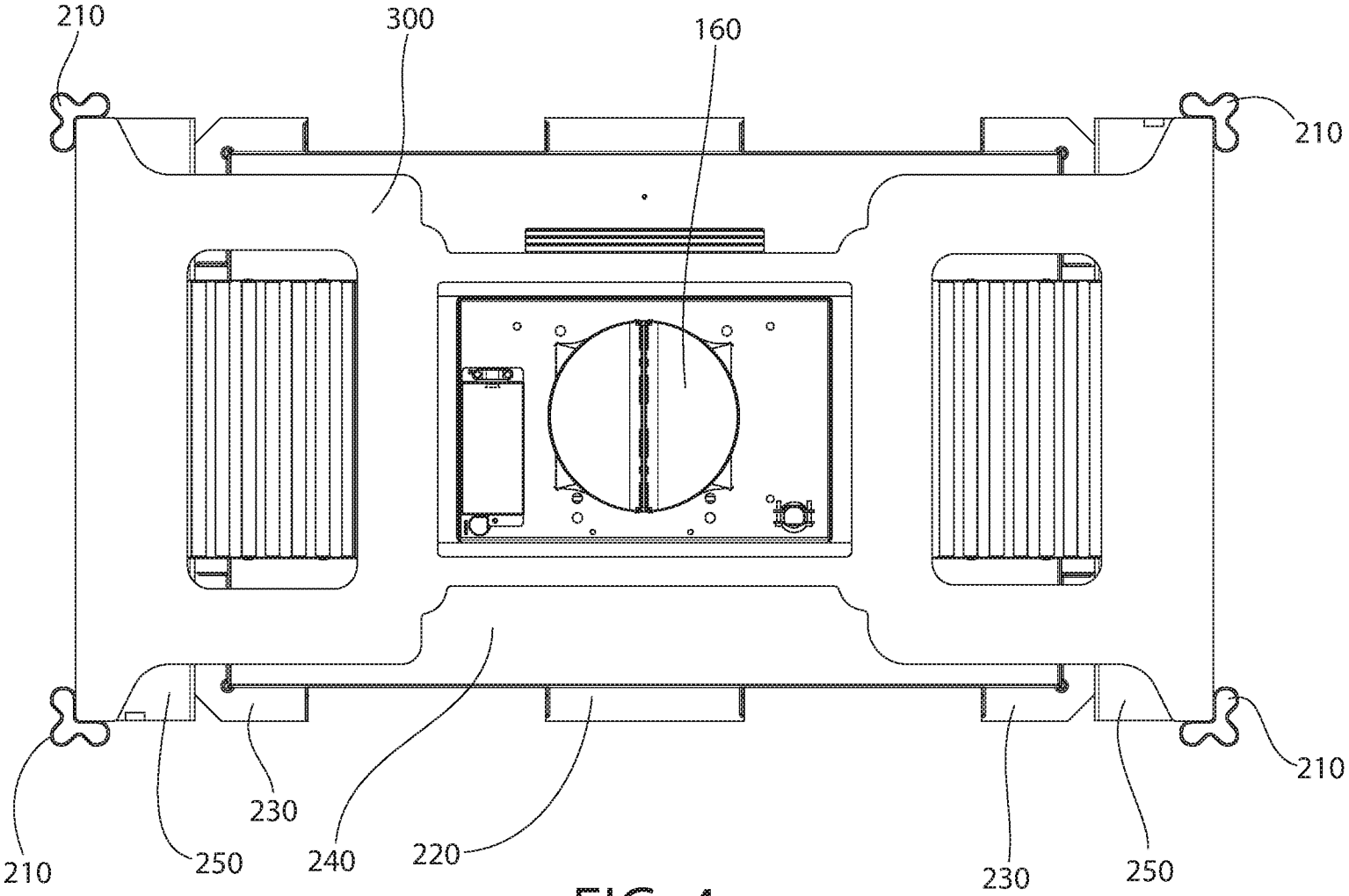
FIG. 4 is a top view of the system shown in FIG. 2.

FIG. 4 is a top view of packing system 200 and shows transition piece 160 located in a central area of the lower packing holder 300.

Figure 5:
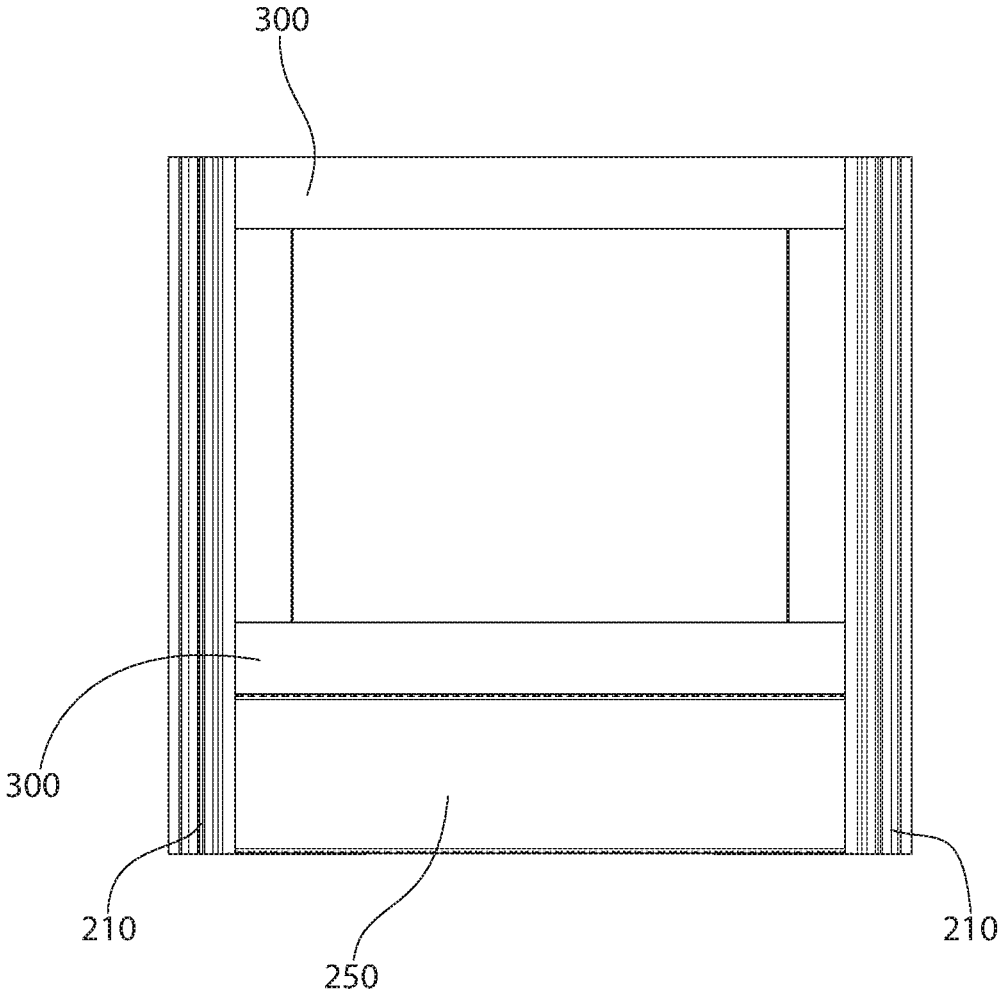
FIG. 5 is a side view of the system shown in FIG. 2.

FIG. 5 is an end view of packing system 200 and shows the spacing of the two packing holders 300.

Figure 6:
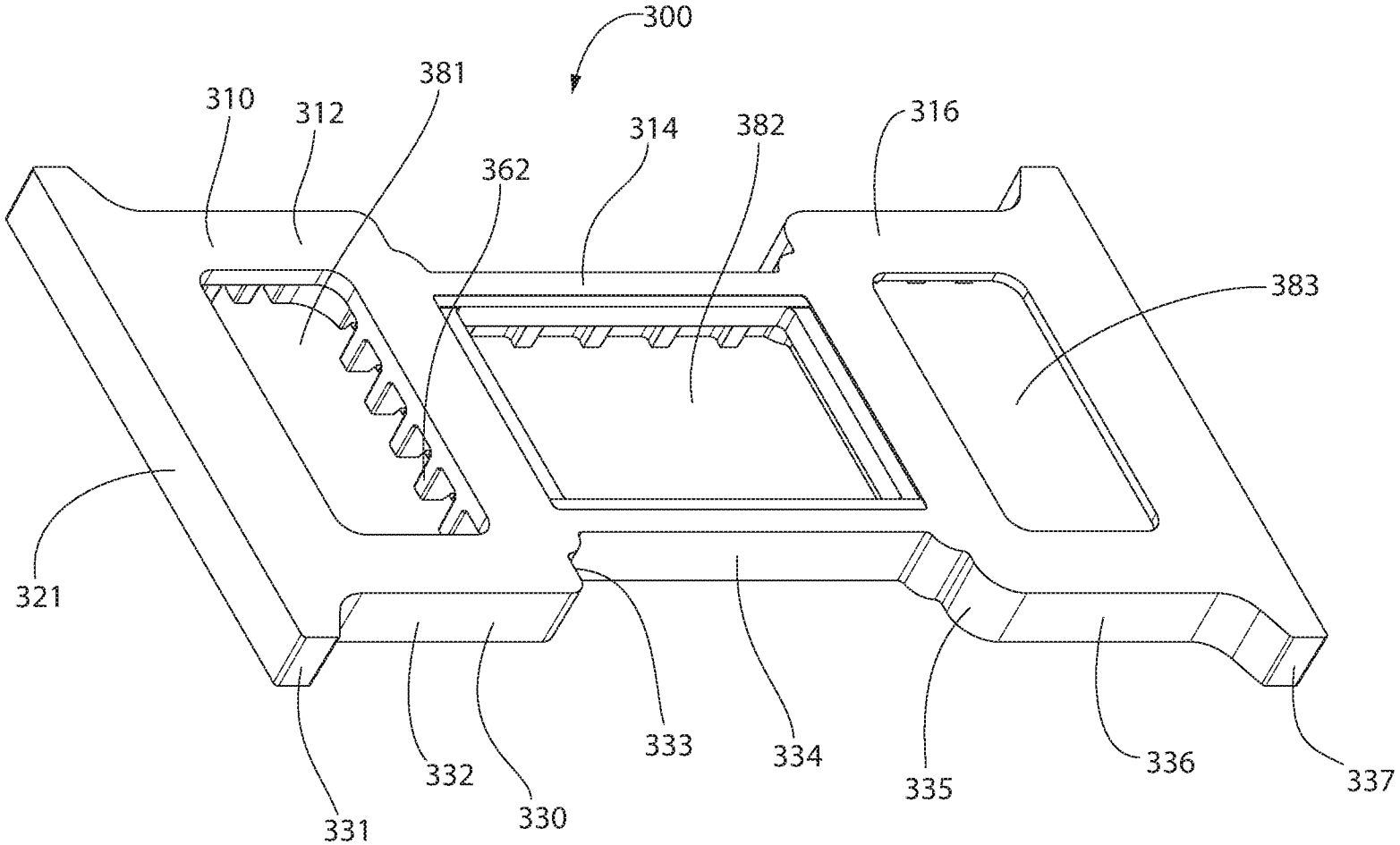
FIG. 6 is a perspective view an outer side of a packing insert in accordance with exemplary embodiments of the invention.

FIG. 6 shows packing holder 300 having an outer surface 310 having three main areas, a first area 312, a second area 316, and a central area 314 located between the first are 312 and the second area 316. First area 312, second area 316, and central area 314 correspond to first, second, and central receiving portions, respectively, on an inner side of packing holder 300 (shown FIG. 7). Also shown in FIG. 6 are an end surface 321 and a side surface 330. Side surface 330 includes surfaces 331, 332, 333, 334, 335, 336 and 337. In this example, end surface 321 and side surface 330 are perpendicular to outer surface 310.

First area 312 has an opening 381 centrally located in first area 312. Central area 314 has an opening 382 centrally located in central area 314. Second area 316 has an opening 383 centrally located in second area 316. Openings 381, 382, 383 reduce the amount of material used in packing holder 300, which reduces the cost and weight of packing holder 300.

Figure 7:
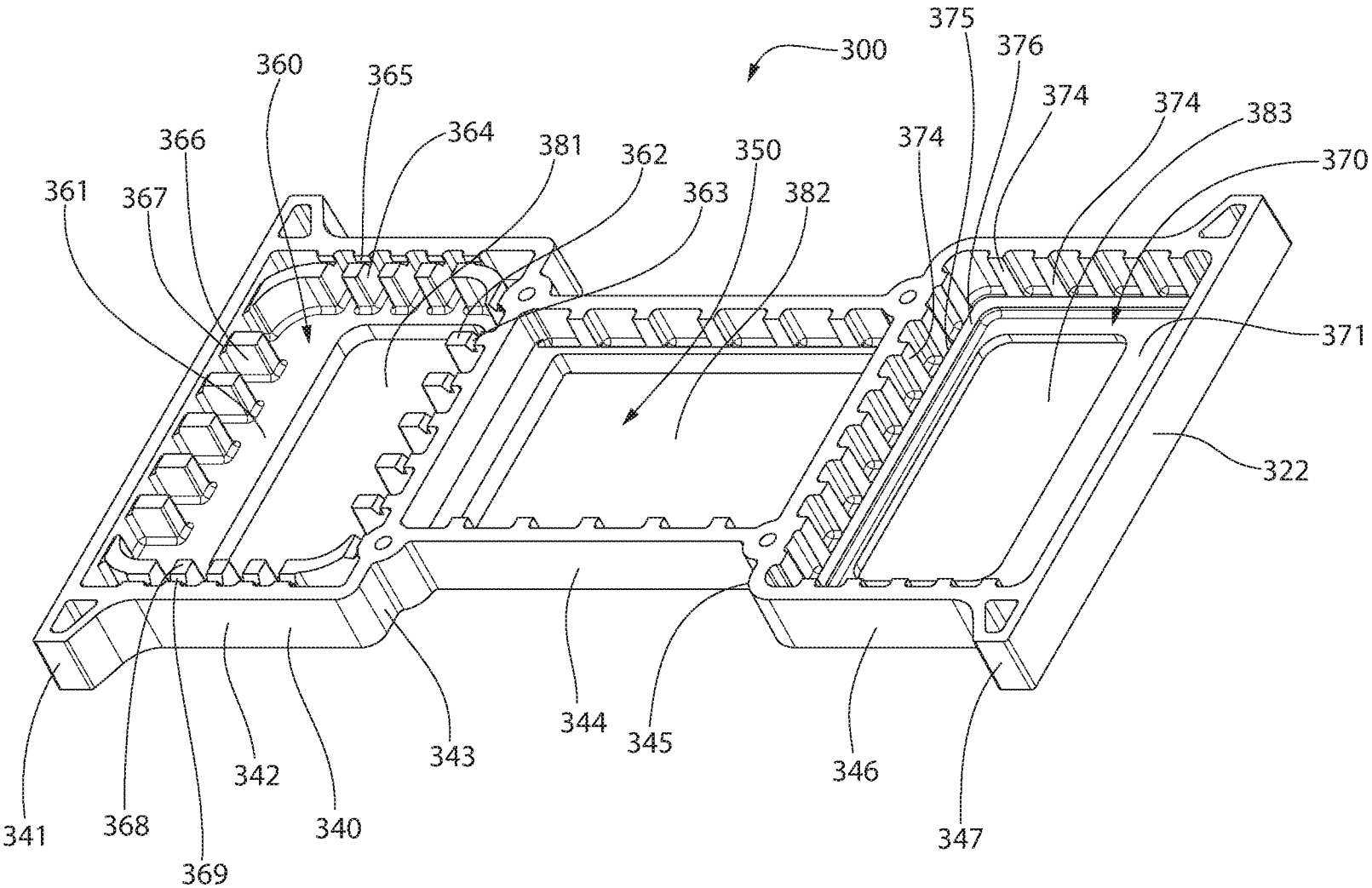
FIG. 7 is a perspective view of an inner side of the packing insert shown in FIG. 6.

FIG. 7 shows the inner side of packing holder 300 in more detail. In this embodiment, the upper and lower packing holders 300 shown in FIGS. 2-5 are identical. The features of packing holder 300 will be explained using packing holder 300 shown in FIG. 7 as the lower of the two packing holders 300 shown in FIGS. 2-5.

In the example shown in FIG. 7, packing holder 300 generally has three main areas, a first receiving portion 360 at one end of packing holder 300, a second receiving portion 370 at the opposite end of packing holder 300, and a central receiving portion 350 located between first receiving portion 360 and second receiving portion 370.

In this embodiment, packing holder 300 is symmetrical relative to a longitudinal axis extending through first receiving portion 160, central receiving portion 150, and second receiving portion 370. In other embodiments, packing holder 300 is asymmetrical relative to the longitudinal axis.

Shown in FIG. 7 are an end surface 322 and a side surface 340. Side surface 340 includes surfaces 341, 342, 343, 344, 345, 346 and 347. In this example, end surface 322 and side surface 340 are perpendicular to outer surface 310.

In the embodiment shown in FIG. 7, and referring back to FIG. 2, first receiving portion 360 has a plurality of ribs arranged generally around a perimeter of first receiving portion 360 and around opening 381. A plurality of ribs 366 are arranged in a row along a side of first receiving portion 360. Each rib 366 has a groove 367 formed in it to receive an edge of a part of extraction hood 100, in this example an edge of first piece 142 of chimney cover 140. A plurality of ribs 368 are arranged in a row along a side of first receiving portion 360. Each rib 368 has a groove 369 formed in it to receive an edge of a part of extraction hood 100, in this example an edge of first piece 142 of chimney cover 140. Because first piece 142 of chimney cover 140 is L-shaped in this example, two sides of first piece 142 rest in grooves 367 and 369. Second piece 144 of chimney cover 140 is similarly supported by two rows of grooved ribs in first receiving portion 360. A plurality of ribs 362 are arranged in a row along a side of first receiving portion 360. Each rib 362 has a groove 363 formed in it to receive an edge of a part of extraction hood 100, in this example an edge of second piece 144 of chimney cover 140. A plurality of ribs 364 are arranged in a row along a side of first receiving portion 360. Each rib 364 has a groove 365 formed in it to receive an edge of a part of extraction hood 100, in this example an edge of second piece 144 of chimney cover 140. Because second piece 144 of chimney cover 140 is L-shaped in this example, two sides of second piece 144 rest in grooves 363 and 365. Additional grooved ribs are located at the corners of first receiving portion 360. These corner ribs are, in this example, radiused to allow room for chimney cover pieces that have radiused corners as opposed to sharp corners. Space is also provided outside of the corner ribs to allow room for chimney cover pieces that have sharp corners.

In this example, grooves 363, 365, 367, 369 are elevated relative to a floor surface 361 of first receiving portion 360. This is in contrast to the elevation of the groove 375 in second receiving portion 370 (discussed further below). Differing groove elevations provide secure holding of chimney cover parts having different lengths.

In the embodiment shown in FIG. 7, and referring back to FIG. 2, second receiving portion 370 has a plurality of ribs arranged generally around a perimeter of second receiving portion 370 and around opening 383. A plurality of ribs 374 are arranged in four rows along the sides of second receiving portion 370. A groove 375 is formed along the bases of ribs 374 to receive an edge of parts of extraction hood 100, in this example an edge of third piece 146 of chimney cover 140 and an edge of fourth piece 148 of chimney cover 140. Because third piece 146 of chimney cover 140 is L-shaped in this example, two sides of third piece 146 rest in groove 375. Fourth piece 148 of chimney cover 140 is similarly supported by groove 375. Because fourth piece 148 of chimney cover 140 is L-shaped in this example, two sides of fourth piece 148 rest in groove 375. Space is provided in the corners to allow room for chimney cover pieces that either have sharp corners or are radiused.

In this example, groove 375 is bordered by ribs 374 on the outside and a plateau 376 on the inside. In this example, groove 375 is at the same elevation as a floor surface 371 of second receiving portion 370 (see FIG. 13). In this example, the elevation of groove 375 is lower than the elevation of grooves 363, 365, 367, 369 in first receiving portion 360. These differing groove elevations provide secure holding of chimney cover parts having different lengths.

Grooves 363, 365, 367, 369 provide secure holding of two L-shaped pieces in first receiving portion 360. Groove 375 provides secure holding of two L-shaped pieces in second receiving portion 370. The exemplary formation of the various ribs and grooves allow for L-shaped pieces of various leg dimensions (those dimensions along the legs of the "L") up to the length of the grooves (and the space in the corner areas). This flexibility is advantageous because it allows one size packing holder 300 to be used with various differently sized extraction hoods.

Central receiving portion 350, in this example, is sized to receive chimney frame 150 and transition piece 160. In some embodiments, transition piece 160 fits inside chimney frame 150 and is held in place by chimney frame 150. Because the inside of chimney frame 150 and the outside of transition piece 160 are not seen by the user in the final installation, in some cases these two parts can contact each other without concern over marring their finishes.

Figure 8:
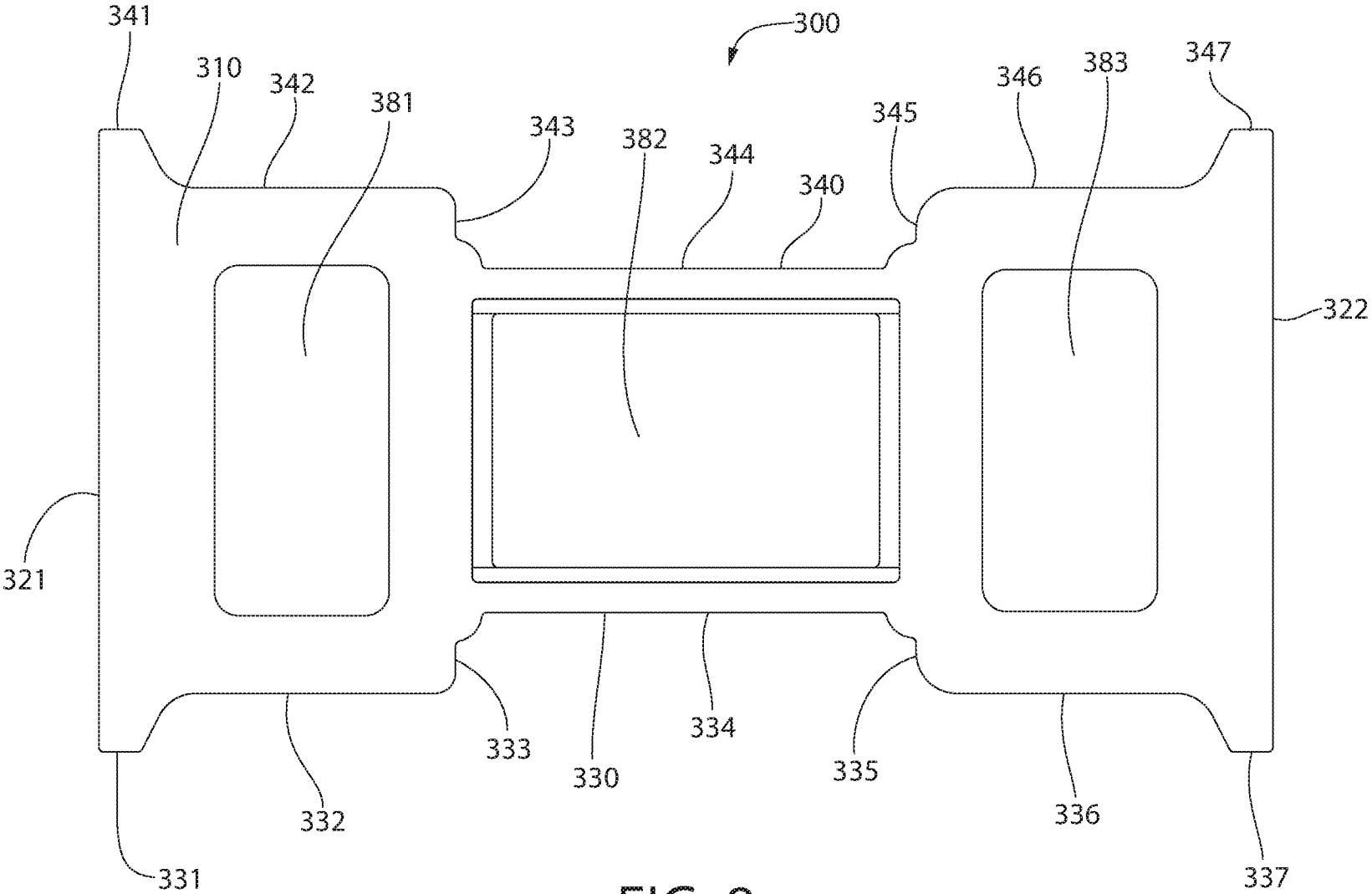
FIG. 8 is an outer side view of the packing insert shown in FIG. 6.
Figure 9:
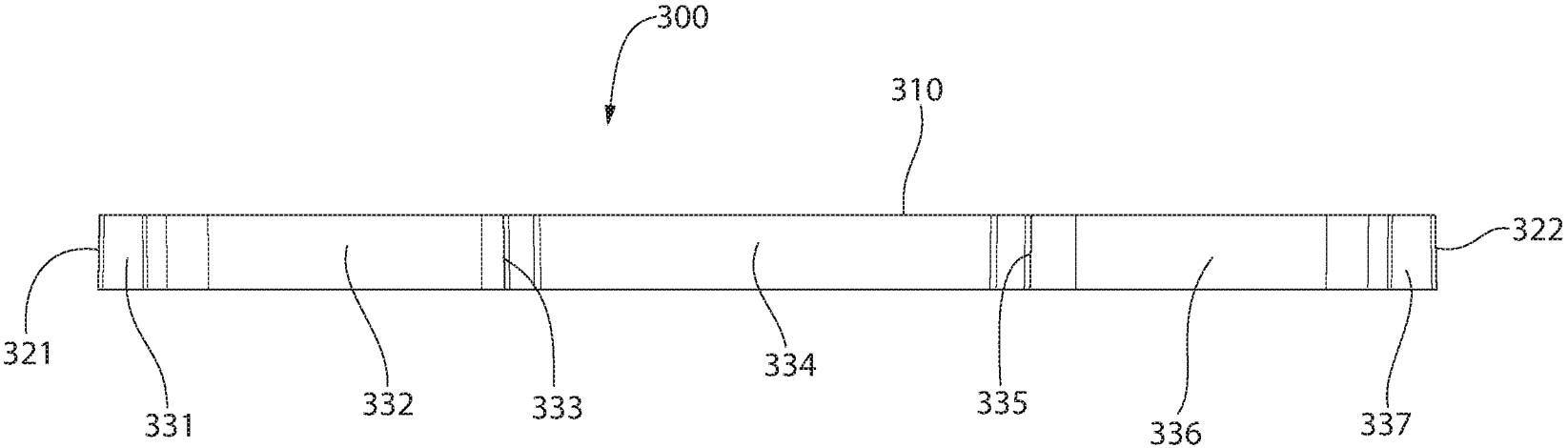
FIG. 9 is a side view of the packing insert shown in FIG. 6.

FIG. 8 shows is a top view of packing holder 300 and shows outer surface 310 and the relative positions of the various edge surfaces. FIG. 9 is a side view of packing holder 300.

Figure 10:
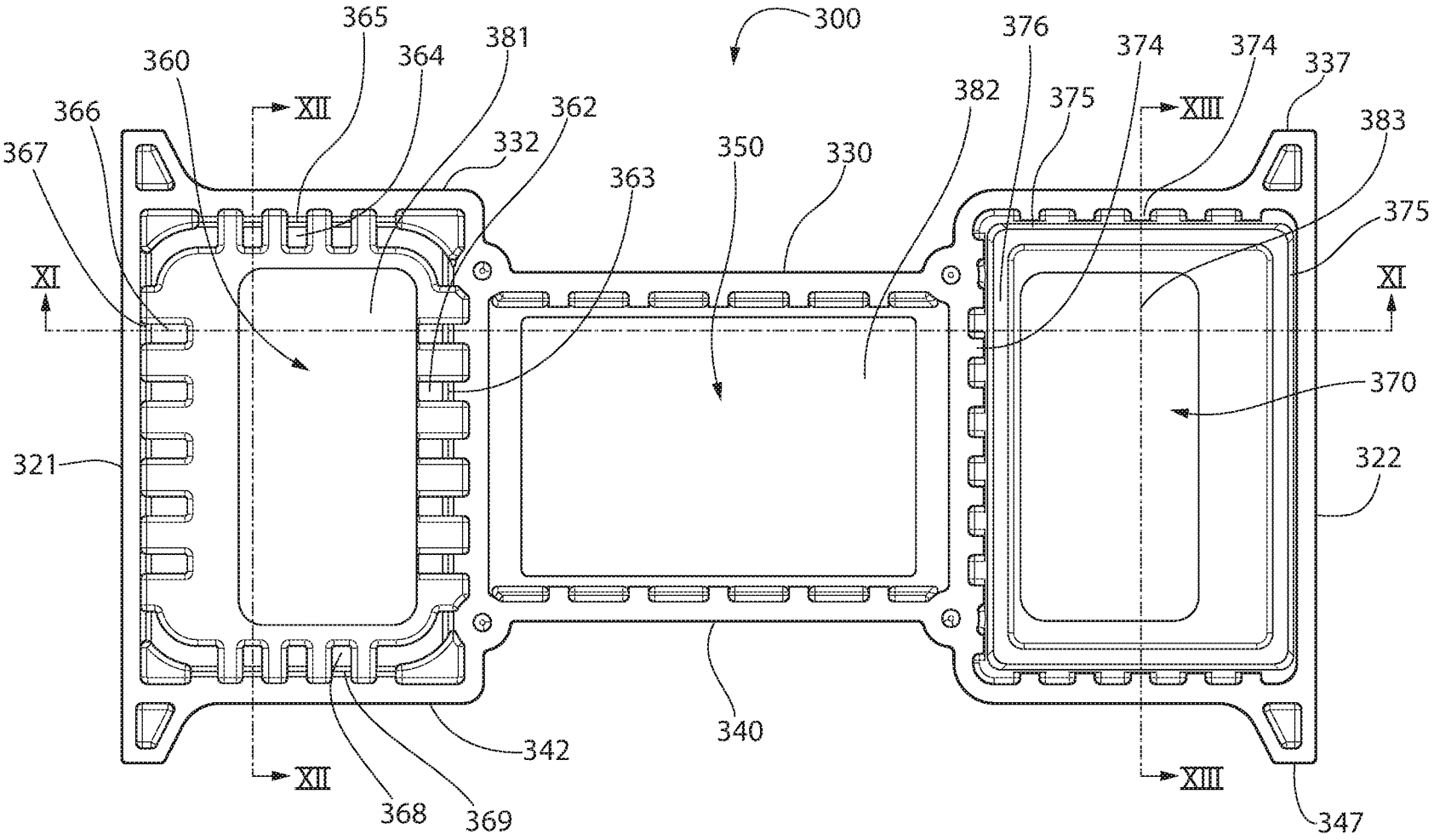
FIG. 10 is an appliance side view of the packing insert shown in FIG. 6.

FIG. 10 is a plan view of the inner side of packing holder 300. FIG. 10 compliments FIG. 7 in the view of grooves 363, 365, 367, 369 in first receiving portion 360 and the view of groove 375 in second receiving portion 370.

Figure 11:
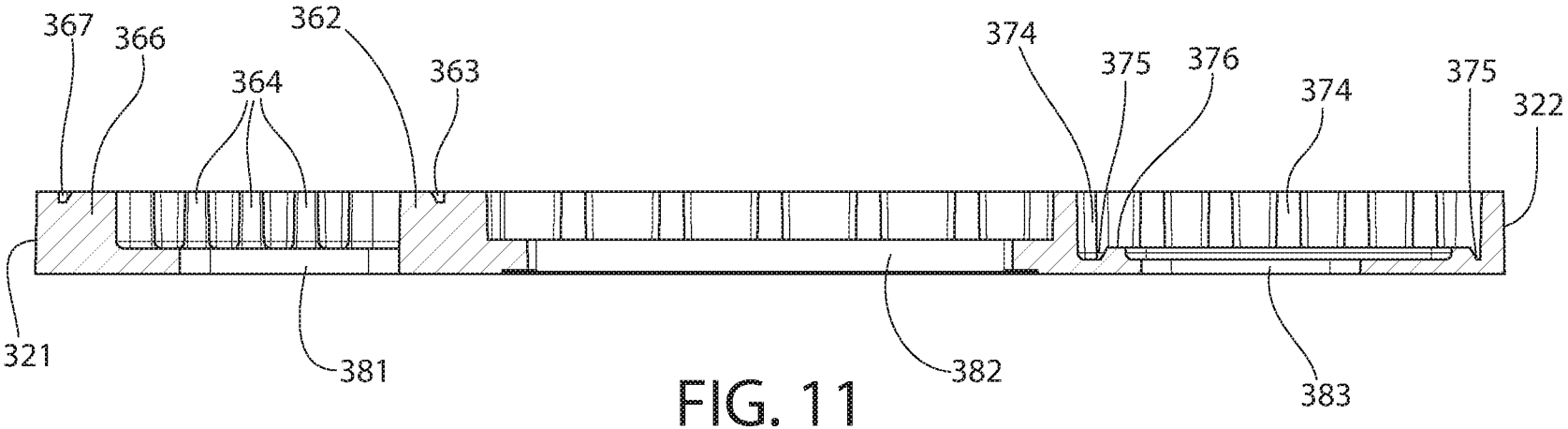
FIG. 11 is a sectional view along section line XI-XI in FIG. 10.

FIG. 11 is a sectional view along section line XI-XI in FIG. 10 and shows the elevation of grooves 363 and 367 relative to groove 375.

Figure 12:
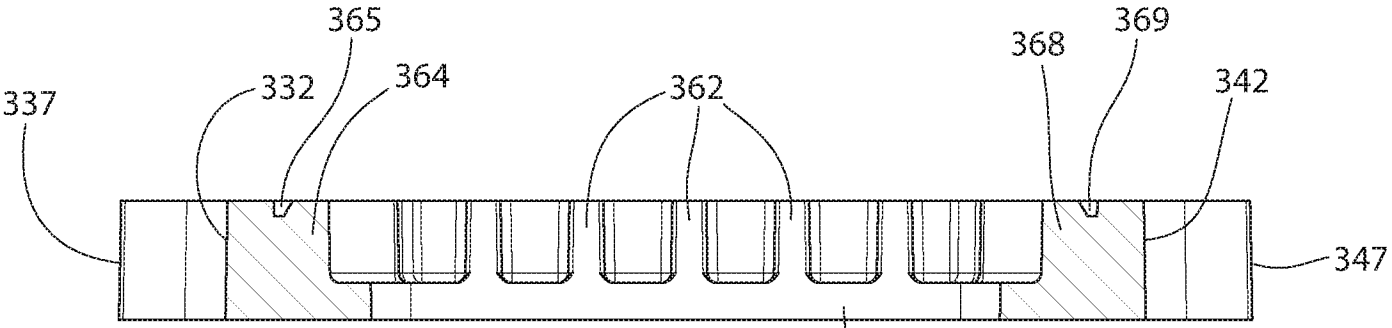
FIG. 12 is a sectional view along section line XII-XII in FIG. 10.

FIG. 12 is a sectional view through first receiving portion 360 along section line XII-XII in FIG. 10 and shows that, in this example, grooves 365 and 369 are at the same elevation.

Figure 13:
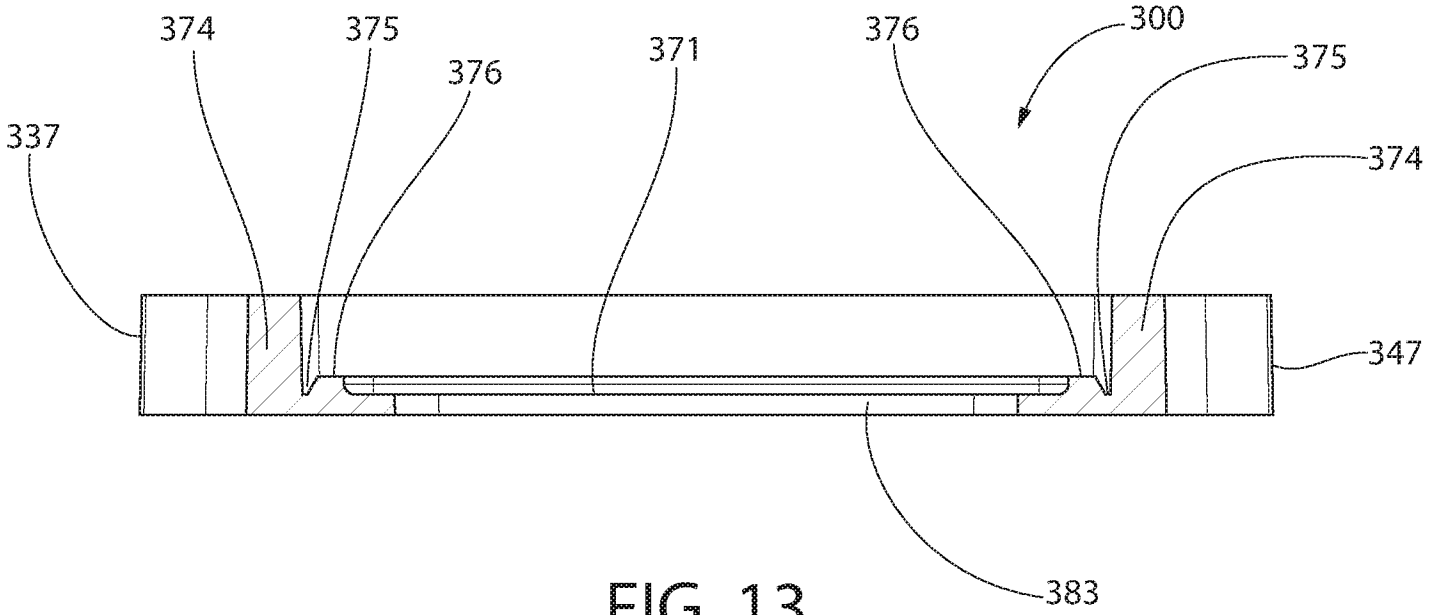
FIG. 13 is a sectional view along section line XIII-XIII in FIG. 10.

FIG. 13 is a sectional view through second receiving portion 370 along section line XIII-XIII in FIG. 10 and shows that, in this example, groove 375 is at the same elevation on both sides of opening 383.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents. In addition, all combinations of any and all of the features described in the disclosure, in any combination, are part of the invention.

What is claimed is:

1. A packing holder for portions of an extractor hood, the extractor hood including a main body, a multi-piece chimney cover, and a chimney frame, the holder comprising:

an outer side having an outer surface;

an inner side opposite to the outer side in a thickness direction;

a first receiving portion in the inner side, the first receiving portion having a first groove configured to receive an edge of a first part of the chimney cover and an edge of a second part of the chimney cover, the first groove having:

a bottom surface that is configured to contact the edge of the first part of the chimney cover and the edge of the second part of the chimney cover when the first part of the chimney cover and the second part of the chimney cover are installed in the packing holder, the bottom surface being a first distance from the outer surface of the outer side in the thickness direction, and an opening in the outer surface such that a first passage way exists between the inner side and the outer side;

a second receiving portion in the inner side, the second receiving portion having a second groove configured to receive an edge of a third part of the chimney cover and an edge of a fourth part of the chimney cover, the second groove having:

a bottom surface that is configured to contact the edge of the third part of the chimney cover and the edge of the fourth part of the chimney cover when the third part of the chimney cover and the fourth part of the chimney cover are installed in the packing holder, the bottom surface being a second distance from the outer surface of the outer side in the thickness direction, and an opening in the outer surface such that a second passage way exists between the inner side and the outer side; and a central receiving portion located between the first receiving portion and the second receiving portion along a longitudinal direction that is perpendicular to the thickness direction, and configured to receive the chimney frame, wherein the second distance is smaller than the first distance; and wherein the packing holder is symmetrical relative to a longitudinal axis that extends through the first receiving portion, the central receiving portion, and the second receiving portion.

2. The packing holder of claim 1, further comprising a plurality of first ribs located in the first receiving portion, wherein the first groove comprises a plurality of first grooves, each of the first grooves being located in one of the first ribs.

3. The packing holder of claim 2, wherein the first grooves are arranged around a perimeter of the first receiving portion.

4. A packing system for portions of an extractor hood, the extractor hood including a main body, a multi-piece chimney cover, and a chimney frame, the packing system comprising:

two packing holders, each of the packing holders having an outer side having an outer surface;

an inner side opposite to the outer side in a thickness direction;

a first receiving portion in the inner side, the first receiving portion having a first groove configured to receive an edge of a first part of the chimney cover and an edge of a second part of the chimney cover, the first groove having a bottom surface that is configured to contact the edge of the first part of the chimney cover and the edge of the second part of the chimney cover when the first part of the chimney cover and the second part of the chimney cover are installed in the packing holder, the bottom surface being a first distance from the outer surface of the outer side in the thickness direction, and an opening in the outer surface such that a first passage way exists between the inner side and the outer side;

a second receiving portion in the inner side, the second receiving portion having a second groove configured to receive an edge of a third part of the chimney cover and an edge of a fourth part of the chimney cover, the second groove having a bottom surface that is configured to contact the edge of the third part of the chimney cover and the edge of the fourth part of the chimney cover when the third part of the chimney cover and the fourth part of the chimney cover are installed in the packing holder, the bottom surface being a second distance from the outer surface of the outer side in the thickness direction, and an opening in the outer surface such that a second passage way exists between the inner side and the outer side; and a central receiving portion located between the first receiving portion and the second receiving portion along a longitudinal direction that is perpendicular to the thickness direction, and configured to receive the chimney frame, wherein the second distance is smaller than the first distance, wherein each of the packing holders is symmetrical relative to a longitudinal axis that extends through the first receiving portion, the central receiving portion, and the second receiving portion, and the two packing holders are configured to be arranged on opposite sides of the main body, the multi-piece chimney cover, and the chimney frame.

5. The packing system of claim 4, wherein each of the packing holders further comprises a plurality of first ribs located in the first receiving portion, wherein the first groove comprises a plurality of first grooves, each of the first grooves being located in one of the first ribs.

6. The packing system of claim 5, wherein the first grooves are arranged around a perimeter of the first receiving portion.

7. A combination of a packing system and an extractor hood, the combination comprising:

an extractor hood main body;

a chimney cover having a first part, a second part, a third part, and a fourth part;

a chimney frame;

two packing holders, each of the packing holders having an outer side having an outer surface;

an inner side opposite to the outer side in a thickness direction;

a first receiving portion in the inner side, the first receiving portion having a first groove that receives an edge of the first part of the chimney cover and an edge of the second part of the chimney cover, the first groove having a bottom surface that contacts the edge of the first part of the chimney cover and the edge of the second part of the chimney cover when the first part of the chimney cover and the second part of the chimney cover are installed in the packing holder, the bottom surface being a first distance from the outer surface of the outer side in the thickness direction;

a second receiving portion in the inner side, the second receiving portion having a second groove that receives an edge of the third part of the chimney cover and an edge of the fourth part of the chimney cover, the second groove having a bottom surface that contacts the edge of the third part of the chimney cover and the edge of the fourth part of the chimney cover when the third part of the chimney cover and the fourth part of the chimney cover are installed in the packing holder, the bottom surface being a second distance from the outer surface of the outer side in the thickness direction; and a central receiving portion located between the first receiving portion and the second receiving portion along a longitudinal direction that is perpendicular to the thickness direction, and receiving the chimney frame, wherein the second distance is smaller than the first distance, and the two packing holders are arranged on opposite sides of the main body, the chimney cover, and the chimney frame.

8. The combination of claim 7, wherein each of the packing holders further comprises a plurality of first ribs located in the first receiving portion, wherein the first groove comprises a plurality of first grooves, each of the first grooves being located in one of the first ribs.

9. The combination of claim 8, wherein the first grooves are arranged around a perimeter of the first receiving portion.

10. The combination of claim 9, wherein each of the packing holders is symmetrical relative to a longitudinal axis that extends through the first receiving portion, the central receiving portion, and the second receiving portion.

11. The combination of claim 10, wherein the first receiving portion has an opening in the outer surface such that a first passage way exists between the inner side and the outer side, and the second receiving portion has an opening in the outer surface such that a second passage way exists between the inner side and the outer side.

12. The combination of claim 7, wherein each of the packing holders is symmetrical relative to a longitudinal axis that extends through the first receiving portion, the central receiving portion, and the second receiving portion.

13. The combination of claim 7, further comprising a main body box that contains the main body; and a main body box support that supports the main body box, wherein the main body box is positioned below a lower one of the two packing holders.

14. The combination of claim 13, further comprising a plurality of corner members, each of the corner members being positioned at a different outside corner of packing members such that the packing members and the main body box are located within a perimeter defined by the corner members.

* * * * *